United States Patent [19]

Campbell

[11] Patent Number: 4,784,171

[45] Date of Patent: Nov. 15, 1988

[54] POOL SWEEP MODIFICATIONS

[76] Inventor: Sanford F. Campbell, 1850 Crestmont Rd., Redding, Calif. 96002

[21] Appl. No.: 109,484

[22] Filed: Oct. 16, 1987

[51] Int. Cl.[4] ..... B08B 9/08

[52] U.S. Cl. ..... 134/167 R

[58] Field of Search ..... 134/167 R, 168 R; 15/1.7; 210/169; 4/490

[56] References Cited

U.S. PATENT DOCUMENTS

| | | | |
|---|---|---|---|
| 3,416,176 | 12/1968 | Ravitts | 15/1.7 |
| 3,926,667 | 12/1975 | Gibellina | 134/167 R |
| 4,434,050 | 2/1984 | Selsted | 134/167 R X |
| 4,461,704 | 7/1984 | Selsted | 134/167 R X |
| 4,675,921 | 6/1987 | Jean-Jacques | 134/167 R X |

*Primary Examiner*—Philip R. Coe

*Attorney, Agent, or Firm*—Leonard D. Schappert

[57] ABSTRACT

A pool sweep modification is provided for adapting an existing pool sweep to operate substantially below the surface of the water of a pool including a flotation device for positioning at one end of the water line of the sweep and a weight for attachment to the pool sweep head positioned at the end of the water line opposite the flotation device, the weight and the flotation device being balanced to maintain the pool sweep head substantially level during operation.

5 Claims, 2 Drawing Sheets

POOL SWEEP MODIFICATIONS

BACKGROUND OF THE INVENTION

1. Field of the Invention

The present invention relates generally to pool cleaning devices, and more specifically to a modification for devices known as pool sweeps which enables the pool sweep to be operated effectively substantially beneath the surface of the water in a pool and beneath a pool cover.

2. Description of the Prior Art

Previous inventors have directed their efforts toward providing pool cleaning devices which generally include a pool sweep head and a flotation device offset from the pool sweep head to allow stable operation on the surface of the water of a pool. While some of these pool cleaners have included devices for positioning beneath the pool cover, such use near the surface of the water in the pool just beneath a pool cover has generally been accomplished only by integrated units which require the purchase of a complete pool sweep. None of the prior art of which applicant is aware has taught a retrofittable flotation device for use with existing pool sweeps which adapts a pool sweep, normally used above the surface of the water, to be utilized just below the surface of the water when operating beneath a pool cover.

SUMMARY OF THE INVENTION

The present invention consists of a flotation device which can be utilized as an integral part of an existing pool sweep to facilitate use of the pool sweep beneath the surface of the water and beneath a pool cover, and which is also retrofittable on most pool sweeps which float on the surface of the water.

The flotation device consists of a replacement float designed to replace the existing float, which is normally positioned at the opposite end of the water line from the pool sweep head, together with a weight designed to be attached to the pool sweep head. The float and the weight are designed to enable use of the pool sweep beneath a pool cover and substantially beneath the surface of the water in a pool. The weight consists of a weight attachable to the pool sweep head to position the pool sweep head below the surface of the water during use. The float consists of a replacement float unit for positioning at the opposite end of the water line from the pool sweep head which includes a pair of wheels attached thereto so that, when the float is placed in a certain position and the weight is not attached to the pool sweep, the pool sweep will operate in much the same manner as it was originally designed to operate. However, when the float is turned over and the weight is attached to the pool sweep head, the pool sweep is lowered substantially below the surface of the water to enable it to operate beneath pool covers.

One of the objects of the present invention is to provide a pool sweep which is capable of efficient operation beneath a pool cover.

Another object of the present invention is to provide a retrofit device for use with existing pool sweeps which, when attached to the existing pool sweeps, enables use thereof beneath a pool cover.

A further object of the present invention is to provide a retrofit unit for use with pool sweeps which provides for the use of the pool sweep in its normal configuration—that is, at or above the surface of the water—and, alternatively, beneath the surface of the water or a pool cover.

Another object of the present invention is to provide a pool sweep modification which includes a float having wheels positioned thereon so that, when the device is utilized beneath a pool cover, movement of the pool sweep beneath the pool cover is facilitated by the movement of the wheels.

The foregoing objects, as well as other objects and benefits of the present invention, are made more apparent by the descriptions and claims which follow.

DESCRIPTION OF THE PREFERRED EMBODIMENT

Figure 1:
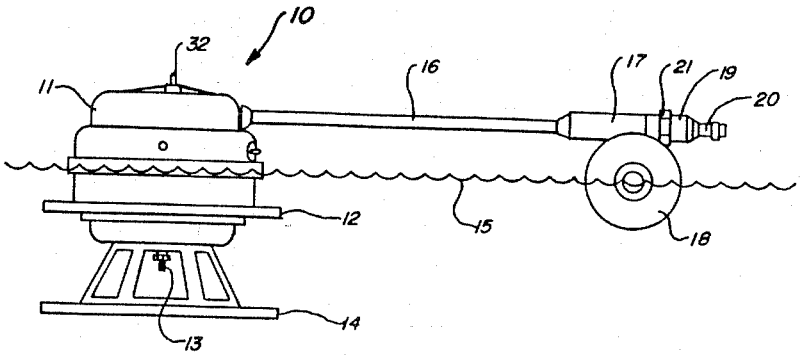
FIG. 1 of the drawings is a side view showing a pool sweep utilizing a pool sweep head together with the float of the present invention in the normal configuration in which a pool sweep has been used in the past.

FIG. 1 of the drawings shows a pool sweep 10 consisting of a pool sweep head 11 connected by rigid water line 16 to a flotation device consisting of float 17 having buoyant wheels 18 attached thereto. Adaptor 19 and adaptor fitting 20 are attached to rigid water line 16 by means of a nut 21. Float 17 is held in position on rigid water line 16 by nut 21 and a screw 28 shown in lo FIGS. 3 and 4. Rings 12 and 14 are attached to pool sweep head 11 as shown, and they turn to move pool sweep 10 along the edge of a pool. A tile cleaner fitting 32 is generally threaded into the top of pool sweep head 11, and it sprays the tile on the sides of the swimming pool. Pool sweep head 11 further has a threaded rod 13 extending downward therefrom as shown. The position of pool sweep 10 with respect to water line 16 is as shown during normal operation.

Figure 2:
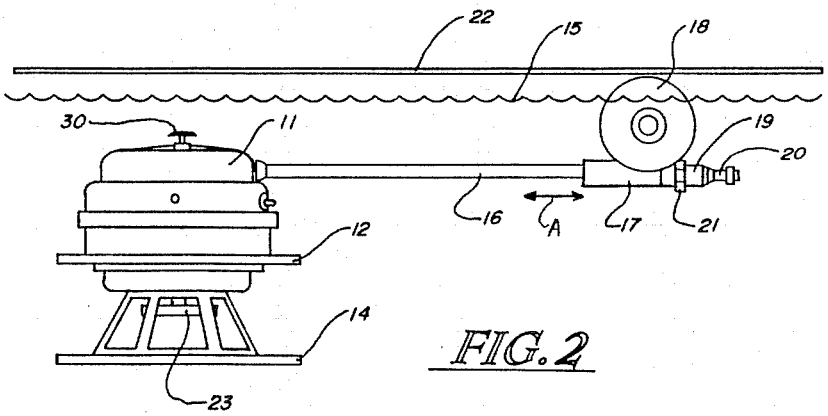
FIG. 2 is a side view showing a pool sweep utilizing the float of the present invention and the weight provided by the present invention to facilitate use of the existing pool sweep head and other equipment below the surface of a pool cover.

FIG. 2 shows float 17 turned over on rigid water line 16, and other modifications to pool sweep head 11 to provide for use of pool sweep 10 substantially below the water level 15 as shown. Buoyant wheels 18 turn with respect to the body of float 17 so that, as they contact pool cover 22, they provide little if any resistance to movement of pool sweep 10 beneath pool cover 22. For use under water or under pool cover 22, the tile cleaner 32 is removed and replaced with a smooth-headed screw 30 to minimize the likelihood of snagging on or damaging pool cover 22. Proper orientation of float 17 with respect to pool sweep head 11 and substantially level orientation of rigid water line 16 are accomplished by means of a weight 23 which is designed to be attached to the threaded rod 13 shown in FIG. 1 of the drawings. Weight 23 balances the unit to keep pool sweep head 11 beneath the surface of water level 15 shown. Float 17 can be moved back and forth on rigid water line 16 as shown by arrow A to achieve proper balance.

Figure 3:
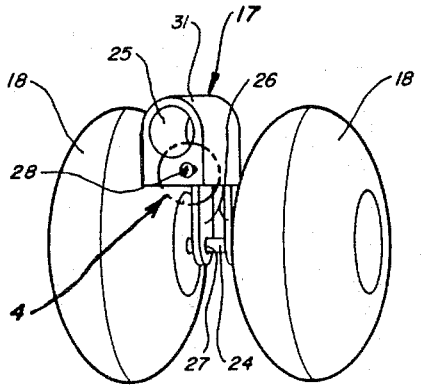
FIG. 3 of the drawings is a perspective view of the float of the present invention.

FIG. 3 of the drawings shows the construction of float 17 in greater detail. Float 17 includes a body 31 having a hole 25 extending therethrough. Rigid water line 16 of FIGS. 1 and 2 extends through hole 25 of body 31. Extensions 26 are rigidly positioned with respect to body 31, and include a hole 27 through them through which an axle extends. Buoyant wheels 18, which are constructed of any appropriate buoyant material, such as styrofoam or any other acceptable buoyant construction, are attached to axle 24 and turn with respect to body 31 and extensions 26. Screw 28, shown in encircled area 4, is utilized to lock body 31 in proper orientation on rigid water line 16 with respect to pool sweep head 10.

Figure 4:
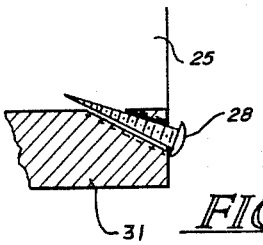
FIG. 4 of the drawings is a cross-sectional view of the area encircled and referred to as 4 in FIG. 3 showing how the float of FIG. 3 is held in rigid position on the water line of FIGS. 1 and 2.

FIG. 4 shows the encircled area 4 of FIG. 3 in greater detail. Specifically, a cross-sectional view of the portion of body 31 encircled and referred to as 4 in FIG. 3 is shown. As here shown, screw 28 is threaded through body 31 at an angle with respect to hole 25 so that it butts against water line 16 when tightened, creating an interference fit between rigid water line 16 and body 31 of float 17.

Figure 5:
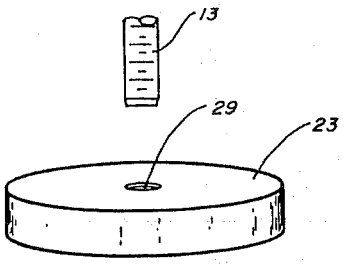
FIG. 5 is a perspective view showing the positioning of the weight utilized to lower the pool sweep head of FIGS. 1 and 2 below the surface of the water as necessary for operation beneath a pool cover.

As shown in FIG. 5 of the drawings, weight 23 is constructed of steel or any other appropriate material and provided with a threaded hole 29 sized and threaded to accept threaded rod 13, which extends downward from the bottom of pool sweep head 10.

Figure 6:
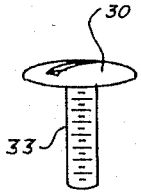
FIG. 6 shows the screw which is utilized with the pool sweep modifications of the present invention to replace the tile cleaner, thereby minimizing the likelihood that the pool sweep will catch on the pool cover.

FIG. 6 shows the construction of smoothheaded screw 30 which includes threads 33 to facilitate its use in replacing tile cleaner 32 of pool sweep head 11 of FIGS. 1 and 2.

While the foregoing description of the invention has shown a preferred embodiment using specific terms, such description is presented for illustrative purposes only. It is applicant's intention that changes and variations may be made without departure from the spirit or scope of the following claims, and this disclosure is not intended to limit applicant's protection in any way.

I claim:

1. A pool sweep modification for use in adapting a pool sweep of the type having a pool sweep head with a top and a bottom and a substantially rigid water line attached thereto for use under a swimming pool cover, comprising:

a flotation device having:

a body;

axle means attached to said body;

buoyant wheel means rotatably attached to said axle means which rotate when oriented to contact said pool cover, and attaching means for attaching said body to said substantially rigid water line in proper orientation so that said axle means is oriented at a substantially right angle to said rigid water line when said body is attached to said substantially rigid water line, and a weight having attaching means whereby said weight is attached to said bottom of said pool sweep head, said flotation device and said weight being matched to maintain said pool sweep substantially level substantially below the water line of said swimming pool, thereby substantially eliminating interference between said pool sweep and said pool cover.

2. The invention of claim 1, wherein said body of said flotation device includes locking means for locking said body in proper orientation to said pool sweep head.

3. The invention of claim 1, wherein said attaching means for attaching said body to said substantially rigid water line consists substantially of a hole oriented at a substantially right angle to said axle means of substantially the shape and size of said substantially rigid water line extending through said body into which said substantially rigid water line extends.

4. The invention of claim 3, including locking means for locking said body in proper orientation with respect to said pool sweep head.

5. The invention of claim 1, including a smoothheaded screw attachable to said top of said pool sweep head whereby a rough surface of said top of said pool sweep head is smoothed, thereby minimizing the likelihood of interference between said pool sweep and said pool cover.

* * * * *